US005989099A

United States Patent [19]

Arnold, III et al.

[11] Patent Number: 5,989,099

[45] Date of Patent: Nov. 23, 1999

[54] TACTILE DEVICE

[76] Inventors: Perry C. Arnold, III, 10300 Jollyville Rd. No. 730, Austin, Tex. 78759; Lawrence David Cutler, 2524 Benvenue Ave. #12, Berkeley, Calif. 94704; Christopher Karl Eisbach, 830 Williams Way #2, Mountain View, Calif. 94040; Brian J. Fogg, P.O. Box 8338, Stanford, Calif. 94309

[21] Appl. No.: 08/866,497

[22] Filed: May 30, 1997

[51] Int. Cl.[6] ..... A63H 33/00

[52] U.S. Cl. ..... 446/487; 434/112

[58] Field of Search ..... 446/484, 487; 434/112, 113, 114, 258; 482/44, 45, 46, 47, 48, 49; 601/40; 463/36, 37, 38, 39; 273/148 B, 438 FOR

[56] References Cited

U.S. PATENT DOCUMENTS

| | | | |
|---|---|---|---|
| 2,782,033 | 2/1957 | Ugartechea | 482/44 |
| 3,514,893 | 6/1970 | Paksy . | |
| 3,779,548 | 12/1973 | Sato | 482/44 |
| 3,900,984 | 8/1975 | Garelick . | |
| 4,300,129 | 11/1981 | Cataldo | 340/539 |
| 4,305,582 | 12/1981 | Barton | 273/1 G |
| 4,414,537 | 11/1983 | Grimes | 340/365 R |
| 4,516,939 | 5/1985 | Crimmons | 434/114 |
| 4,795,296 | 1/1989 | Jau . | |
| 4,905,001 | 2/1990 | Penner | 434/114 |
| 4,929,211 | 5/1990 | Resnick et al. | 446/14 |
| 4,984,784 | 1/1991 | Bailey | 482/49 |
| 5,047,952 | 9/1991 | Kramer et al. | 364/513.5 |
| 5,141,478 | 8/1992 | Upper | 482/44 |
| 5,228,356 | 7/1993 | Chuang | 273/148 B |
| 5,302,148 | 4/1994 | Heinz | 446/119 |
| 5,488,362 | 1/1996 | Ullman et al. | 341/20 |
| 5,506,605 | 4/1996 | Paley | 345/163 |
| 5,525,089 | 6/1996 | Heinz | 446/119 |
| 5,580,336 | 12/1996 | Coallier | 601/40 |
| 5,583,478 | 12/1996 | Renzi | 340/407.1 |
| 5,612,689 | 3/1997 | Lee | 341/20 |
| 5,643,087 | 7/1997 | Marcus et al. | 463/38 |
| 5,800,561 | 9/1998 | Rodriguez | 601/40 |

*Primary Examiner*—Robert A. Hafer
*Assistant Examiner*—Jeffrey D. Carlson
*Attorney, Agent, or Firm*—Julian Caplan Flehr Hohbach Test Albritton & Herbert LLP

[57] ABSTRACT

A hand operated tactile device including a tactile body positionable in a hand of a user. The tactile body includes at least one articulated member movable relative to the remainder of the body in a manual operation phase with the user manipulating the articulated member relative to the remainder of the body and in an automatic operation phase with the articulated member being manipulated relative to the remainder of the body and the hand of the user. A control system is carried by the body. The control system receives a first signal from the articulated member when the articulated member is manually manipulated by the user and control system generates a second signal controlling movement of the articulated member to automatically move the articulated member relative to the remainder of the body and the hand of the user.

9 Claims, 4 Drawing Sheets

TACTILE DEVICE

BRIEF DESCRIPTION OF THE INVENTION

This invention relates in general to a hand-held tactile device and, more particularly, to a tactile device which may be manipulated by the user for communication, interaction with others, entertainment, and/or relaxation.

BACKGROUND OF THE INVENTION

An individual is often required to participate in an activity which does not require his full attention, resulting in boredom, irritation and anxiety which may eventually interfere with the individual's ability to concentrate on the activity. Examples of such situations include attending classes or seminars, talking on the telephone, and the like. Even when the subject matter is interesting, an active individual may become restless and have a tendency to fidget while listening to the speaker. The individual often attempts to relieve such boredom or restlessness by doodling, playing games such as tic-tac-toe, and the like. A hand-held device which may be used by the individual for entertainment to relieve restless, boredom and/or satisfy a need to fidget while allowing the individual to concentrate on the speaker or primary activity for a greater period of time is desirable.

A variety of hand-held objects, toys and the like are available for the entertainment and/or relaxation of the user. One type of object generally consists of a resilient material which may be manipulated by the user. The action of repeatedly squeezing the object is intended to relax the user while strengthening muscles in the hand and forearm. An example of such a device is disclosed in U.S. Pat. No. 4,929,211. While this type of object may be used to occupy and exercise the hand, it provides no mental stimulation or challenge for entertaining the user. Puzzle devices which are manipulated by the hands of the user are available to provide mental stimulation and entertainment. However, these puzzle devices may impair the user's ability to concentrate on the primary activity. Since both hands are typically required to manipulate the device, the puzzle device is not a suitable source of entertainment when one hand must remain free for other activities, for example writing or holding a telephone. Those puzzle devices which may be used by more than one person are unsuitable for entertaining the user while he participates in the primary activity, for example attending a class or a seminar. While these types of devices may entertain the user, they often require that the user shift his visual attention to the device rather than the speaker or presentation. Moreover, these devices may not be used as a means of communication or interaction for individuals in different locations or for individuals present under conditions which prevent the individuals from speaking to one another.

In many situations, such as a class or a meeting, an individual may want to communicate with others participating in the activity, sharing thoughts on the speaker's comments or on unrelated subject matter. However, it is difficult to communicate with others sitting nearby without creating a disturbance and nearly impossible to have meaningful interaction with individuals located several seats away. A tactile device which permits the user to communicate or interact with others without creating a disturbance is desirable. In some instances, the individual may want to communicate or interact with an individual who is not participating in the activity. A tactile device which allows for communication or interaction between individuals at different locations is also desirable.

Interface devices which arc worn on the user's hand and used to transmit a signal to a computer translating the user's hand movements into alpha-numeric characters are available. U.S. Pat. No. 4,414,527 discloses an example of data entry glove. U.S. Pat. No. 5,612,689 discloses an example of such an interface device which may be used in place of a keyboard. U.S. Pat. No. 5,488,362 shows glove for controlling a video game. U.S. Pat. No. 5,047,952 discloses an instrumented glove which may be used to communicate hand signals to a microcomputer. Although these devices may be used to transmit input from the user's hand motions to a computer, this interaction is one-way—from the user to the computer. These input devices do not supply tactile output to the user.

U.S. Pat. No. 4,300,129 discloses a belt buckle with an alarm which is activated by distending the waist to activate a transmitter. Although the device may be used to transmit an alarm signal, the device is not suitable for meaningful communication or interaction with others through tactile signals. Moreover, the alarm device does not receive signals or transmit those signals to the user. Although the alarm provides a warning signal prior to activating the transmitter, this warning signal originates from the alarm device, not an outside source.

U.S. Pat. No. 5,583,478 discloses a virtual reality device in which signals are transmitted to a device worn on the hand to simulate a sense of touch. Although the device may be used to subtly reproduce a sense of touch, the device is not used to supply a tactile signal to communicate or interacted with the user.

A tactile device which may be used to transmit output as well as receive input, allowing the user to communicate or interact with others through tactile signals, is desirable.

OBJECT AND SUMMARY OF THE INVENTION

It is a primary object of this invention to provide a tactile device which exchanges tactile signals with the hand of the user.

It is a further object of this invention to provide a tactile device which may be used to communicate and/or interact with others using a tactile language.

It is another object of this invention to provide a tactile device which entertains, challenges and stimulates the user.

It is still another object of this invention to provide a tactile device which may be manipulated by one hand.

A more general object of this invention is to provide a tactile device which fits comfortably and discretely in the hand, is easy to use, and which is sufficiently rugged to withstand repeated use.

In summary, this invention provides a hand operated device for exchanging tactile signals with the hand of the user. The device includes a tactile body of a size and shape such that the tactile body may be comfortably positioned in one of the user's hands and a control system for controlling operation of the device. The tactile body is configured to communicate with the user's hand through the sense of touch, receiving and transmitting tactile signals. The tactile body includes at least one articulated member which is movable relative to the remainder of the body in two operational phases. In the manual operation phase, the user manipulates the articulated member relative to the remainder of the tactile body to communicate a tactile signal to the control system of the device. In the automatic operation phase, the control system actuates the articulated member, manipulating the articulated member relative to the remainder of the tactile body and the user's hand, to deliver a tactile signal to the user.

In one aspect of the invention, the hand operated device may be used to interact with others. The control system transmits output to a source remote from the device, such as a second device, based upon the tactile input received from the manual movement of the articulated member by the user. The control system receives input from the exterior source and uses this input to generate the signals for automatically moving the articulated member relative to the user's hand. In another aspect of the invention, the device may be used for solitary entertainment. The control system has one or more movements or signal patterns stored therein. The control system moves the articulated member relative to the user's hand in response to the input received from the user in accordance with the one or more of the stored patterns. The tactile device may be configured to operate alternately in the multi-player mode and the stand-alone mode, and may include a switch actuable by the user for selecting the desired mode of operation.

DETAILED DESCRIPTION OF THE INVENTION

Reference will now be made in detail to the present embodiments of the invention, which are illustrated in the accompanying figures. Turning now to the drawings, wherein like components are designated by like reference numbers throughout the various figures, attention is directed to FIGS. 1–2.

Figure 1:
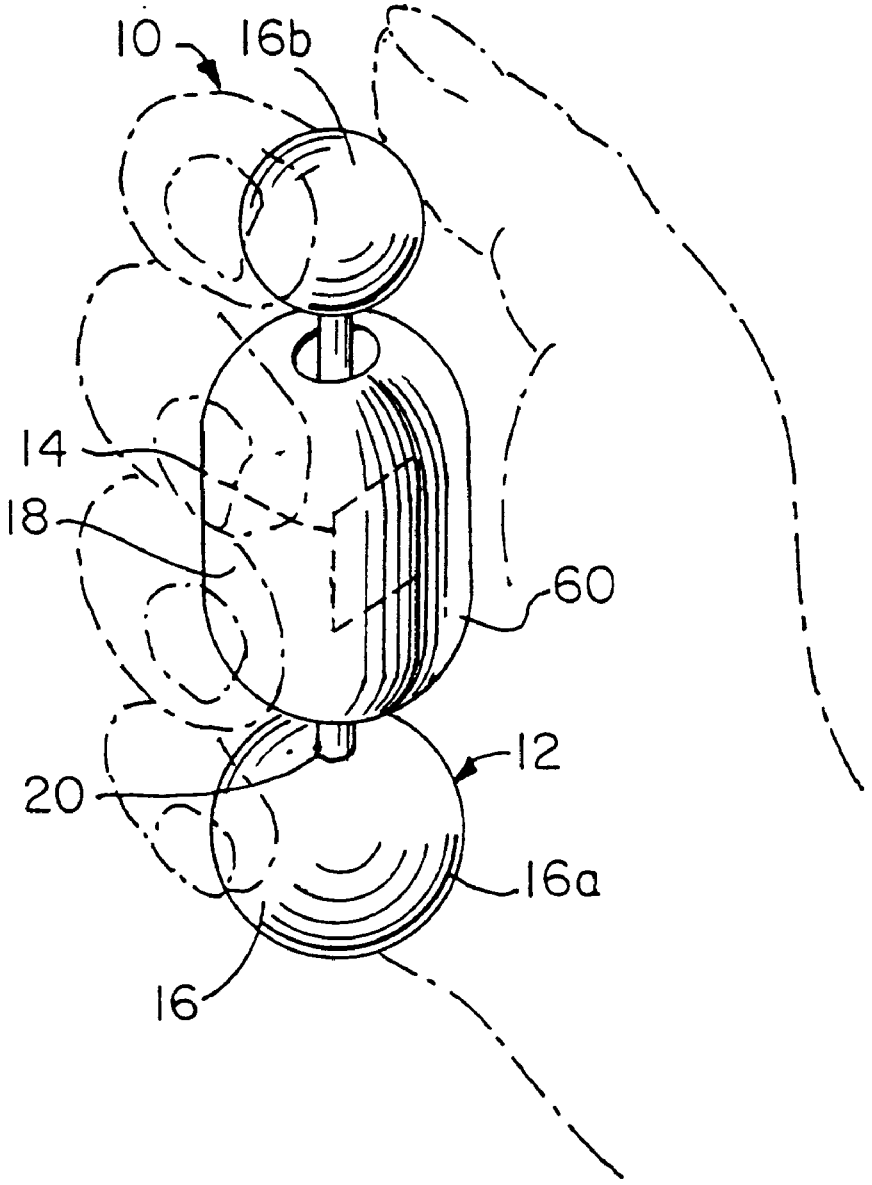
FIG. 1 shows a pictorial view of a tactile device in accordance with the present invention.
Figure 2:
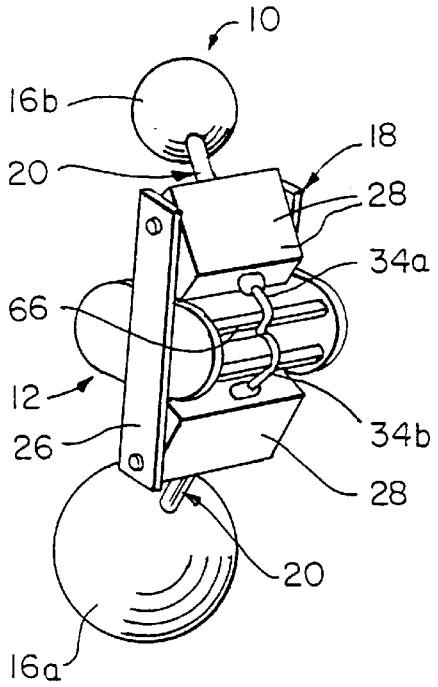
FIG. 2 is a pictorial view, partially broken away, of the tactile device of FIG. 1.
Figure 4:
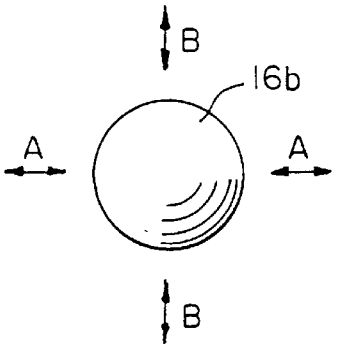
FIG. 4 is an enlarged top view of the tactile device of FIG. 1.

FIGS. 1–2 show a hand operated tactile device 10 incorporating the invention. The hand-held device 10 is particularly suitable for use as a means of communication or interaction with others or as a source of entertainment and amusement. As is shown for example in FIG. 1, the device 10 generally includes a tactile body 12 which fits comfortably and unobtrusively in the user's hand, allowing the user to discretely use the device in a variety of situations without disrupting others or calling attention to the user. Thus, the hand-held device is particularly suitable for use in classrooms, seminars, meetings and the like where the device may be used to communicate with others participating in the activity or located at remote locations, or to entertain the user, relieving boredom or restlessness while still allowing the user to concentrate on the speaker. Although a portable device is of particular advantage, it is to be understood that the tactile body 12 may be mounted to a base or other structure which supports the tactile body as it is manipulated by the user's hand.

The tactile body 12 is adapted to exchange tactile signals with the hand of the user; that is, the tactile body 12 receives a first tactile signal from the user's hand and the control system 14 activates the tactile body to transmit a second tactile signal to the user's hand. In the illustrated embodiment of the invention, the tactile signals are provided by manipulating portions of the tactile body 12. However, it is to be understood that in other modifications of the invention, the tactile body 12 may provide other sensations in addition to or instead of manipulating portions of the tactile body such as a mild shock, vibrations, and the like. For example, vibrations or shocks may be used to add emphasis, communicate a victory or defeat in a competitive activity, or add a beat or rhythm in a collaborative dance activity.

In the embodiment shown in FIGS. 1–4, tactile body 12 includes a pair of articulated members or knobs 16 coupled to opposite ends of an intermediate support 18. It is to be understood that the configuration of the knobs 16 is subject to considerable variation in accordance with user preference. In the illustrated embodiment, the knobs 16 have a round or spherical shape and are preferably formed of a material which feels comfortable to the hand. Examples of suitable materials include, but are not limited to, metals, rubber, plastic and the like. Instead of a spherical shape, the knobs 16 may be formed in the shape of a rod, a square, a triangle, a pyramid and other geometrical shapes as well as random three-dimensional shapes which comfortably and ergonomically fit in the hand. Although not shown, finger grips, detents and the like may be formed on the knob surface to facilitate movement of the knobs. As is shown in FIG. 1, the lower knob 16*a* is larger than the upper knob 16*b* so that the tactile body 12 is easier to hold for most individuals. However, in other modifications of the invention the knobs 16*a*, 16*b* may be of substantially the same size or the upper knob may be larger than the lower knob. For some users, a tactile body 12 in which the upper knob is larger than the lower knob is easier to hold. The knobs 16 may be removable to allow the user to customize the tactile body 12 to his personal preference, selecting knobs of the desired size, shape, material, color and appearance. The removable knobs may be attached using any suitable means such as threaded fasteners, slot-key arrangements and the like.

The knobs 16 are each coupled to the intermediate support 18. The intermediate support may be formed of the same material as the knobs 16 or a different material, and is preferably resilient to cushion the hand and provide greater comfort. A pivotal connector 20 couples the knobs 16 to the support 18 such that the knobs 16 may be pivoted relative to the support 18. Preferably, the knobs 16 are moved in different directions depending upon whether the tactile signal is initiated by the user's hand or the control system 14. For example, in the illustrated embodiments the knobs 16 may be pivoted back and forth in the direction of Arrow A by the user to supply a first tactile signal to the tactile body 12, while the knobs may be moved back and forth in the direction of Arrow B by the control system 14 to provide a second tactile signal to the user's hand. The directions of Arrow A and Arrow B are preferably orthogonal so that the user can clearly identify those signals received from the device. However, it is to be understood that movement along directional arrows intersecting at other angles is within the scope of this invention. Providing different directions of movement for signals initiated by the user and signals imitated by the device is of particular advantage in that the user may easily and clearly distinguish between those signals created by tie user's hands and those initiated by the control system 14. However, an input/output tactile device in which the motions of the articulated members are the same for user-initiated and device-initiated tactile signals is within the scope of this invention.

Figure 3:
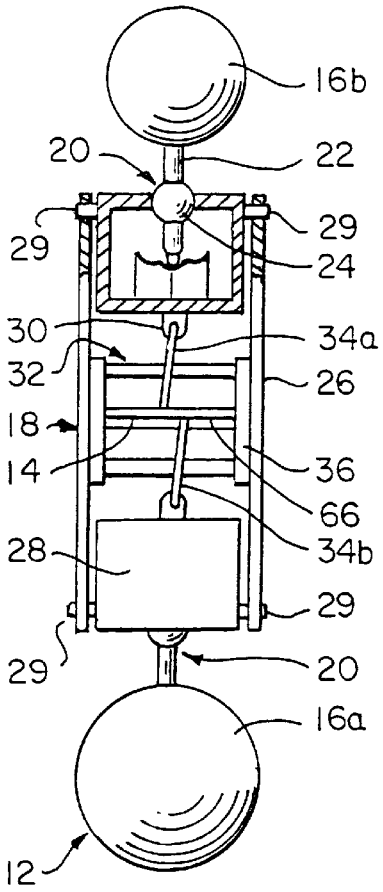
FIG. 3 is an enlarged front plan view, partially broken away, of the tactile device of FIG. 1.

As is shown particularly in FIGS. 2 and 3, the pivotal connector 20 includes a stem 22 mounted to the knob 16. A pivot 24 couples the stem 22 to a three position rocker switch 28 which defines three discrete positions for the knob 16 relative to the support 18 in the plane defined by Arrow A—a neutral position with the knob 16 substantially aligned with the longitudinal axis of the intermediate support 18, and forward and backward positions in which the knob 16 is oriented at an angle relative to the neutral position. The control system 14 is coupled to the switch 28 and, when the user moves the knob 16 relative to the intermediate support 18, the switch 28 is used to detect the position of the knob 16. It is to be understood that means other than pivot 24 and rocker switch 28 may be used to pivot the knob 16 relative to the intermediate frame 26 and to communicate the position of the knob 16 to the control system 14.

The rocker switch 28 is pivotally mounted to the intermediate frame 26 by arms 29 for pivotal movement of the rocker switch 28, stem 22 and knob 16 back and forth in the direction of Arrow B. An actuator, generally designated at 32, is coupled to the rocker switch 28 for producing pivotal movement of the rocker switch in the direction of Arrow B. In the illustrated embodiment, the actuator 32 includes sections of wire 34*a* and 34*b* coupled to the tab 30 of the rocker switch and extending around opposite sides of a frame 36. The wire is Nitionol wire, a titanium nickel alloy also known as memory wire which contracts when power is applied to the wire and is allowed to stretch or expand when the supply of power to the wire is discontinued. Although not shown, the actuator 32 further includes a power source and a switch coupled to selectively supply power to one of the sections 34*a* or 34*b* in response to a signal from the control system 14 and cause the associated wire to contract, pivoting the rocker switch 28 away from the shrinking wire. The opposite wire section is allowed to stretch so that pivotal movement of the rocker switch 28 is not impeded by the wire. The forward and backward positions are determined primarily by the length of the contracted wire.

Figure 5:
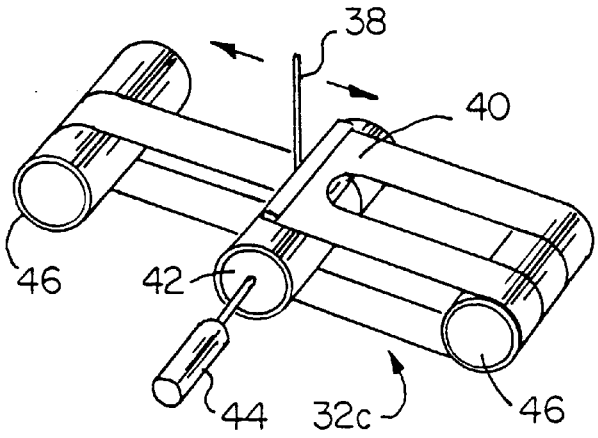
FIG. 5 is a pictorial view, partially broken away, of an actuator of another embodiment of a hand-held device in accordance with the present invention.

Instead of actuator 32 with wire sections 34*a* and 34*b*, other means may be used to pivot the stem 22 and rocker switch 28 assembly. FIG. 5 shows another embodiment of an actuator 32*c* for pivoting the rocker switches in the direction of Arrow B. Actuator 32*c* includes a pin 38 which is coupled to the rocker switch. The pin 38 is mounted to a belt 40 which travels in a path around a drive roller 42 driven by a reversible motor 44 and guide rollers 46. The belt is moved forward and backward in the direction of the arrows to pivot the rocker switch 28*c* and knob 16*c* relative to the intermediate support 18*c*. The motor 44 is coupled to the control system, which selectively actuates the motor 44 to produce the desired movement of the knobs to communicate with the user.

Providing the hand-held device 10 with two knobs, as shown in FIGS. 1 and 2, is of particular advantage because the device 10 is provided with a linear arrangement which fits comfortably in the hand. Another advantage of two knobs 16 is that a variety of different tactile signals are available with two knobs as is discussed in more detail below in relation to FIG. 6. However, in other modifications of the invention the hand held device may have a single knob 16*c* or more than two knobs.

As is shown particularly in FIG. 1, in the illustrated embodiment the intermediate support 18 includes an outer shell 60 covering the frame 26, rocker switches 28 and the components of the control system 14. The outer shell 60 is preferably formed of a resilient material which feels comfortable in the hand. The outer shell 60 may also include an inner layer of insulating material which isolates the frame 26 and the components attached thereto from the user's hand while protecting these components from shock or damage during normal operation and handling of the device 10. Although not shown, instead of knobs 16 projecting outwardly from the intermediate support 18, the hand-held device may include an outer shell which extends around skeletal articulated members.

Control system 14 generally includes a circuit board 66 carried by the frame 26 of the intermediate support 18. The circuit board 66, which includes the circuitry necessary for sensing movement of the knobs 16 by the user in the direction of Arrow A and actuating the knobs 16 for movement in the direction of Arrow B, is electrically connected to the rocker switches 28 and actuator 32. A power source (not shown), such as a miniature battery, supplies the power for the control system 14. In accordance with this invention, the control system 14 may be configured to communicate with other hand-held devices 10. In this instance, the circuit board 66 also includes a transmitter and a receiver for transmitting signals to and receiving signals from other devices. The device may be a duplicate of the tactile device 10 or the device may be a different device which is configured to cooperate with the device 10. The circuit board 66 is programed to translate the signals from the rocker switches 28 into an output signal which is sent to the other device via the transmitter, and to translate input signals received from other device into instruction signals for actuating the actuator 32. The actuator 32 selectively supplies power to one of the wire sections 34*a* or 34*b* to move the knobs 16 relative to the hand as discussed above, with the resulting tactile signal being initiated by the other device. By repeatedly sending and receiving output signals and input signals, two or more devices may be used to communicate via a tactile language or to interact with others by competing in a game, dance and the like. In the illustrated embodiment, the control system 14 includes an RF transmitter and receiver providing an operating range of at least 100 feet. However, cellular or network transmission systems may be employed to increase the range of communication if desired. In addition, if operation only within a limited range is desired, the transmitter and receiver may be replaced by a wire system coupling two or more devices together.

In another modification of the invention, the control system 14 may be configured to operate the tactile device 10 as a stand-alone device. In this instance, the control system 10 includes a memory unit for storing tactile signal patterns. The circuit board is programed to receive the signal from the rocker switches 28 and transmit a response signal to the actuator 32, moving the knobs 16 in the direction of Arrow B, in accordance with one of the signal patterns retained in the storage device. In this manner, the user may manipulate the knobs 16 to play solitaire games retained in the storage device.

If desired, the control system 14 may be configured to operate the tactile device in both modes. In this instance, the control system 14 further includes a switch actuable by the user for switching between the multi-player mode, where signals are transmitted to and received from other devices, and a stand-alone mode where the user operates the tactile device alone. With this modification of the invention, the user may operate the device 10 even in situations where other players are not available.

Figure 6:
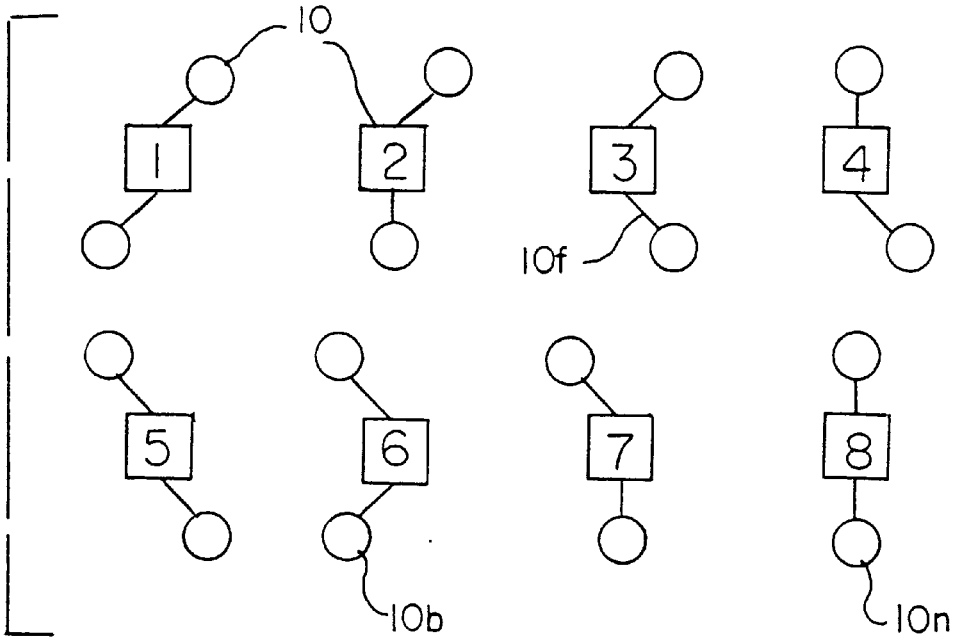
FIG. 6 is a diagrammatic view of the tactile device of FIG. 1, showing the articulated members in different positions.

Turning to FIG. 6, the hand-held tactile device 10 is diagrammatically illustrated with the knobs 16 moved to different positions by the user in the direction of Arrow A. It is to be understood that the movements of the knobs 16 by the control system 14 in the direction of Arrow B are identical to those shown in FIG. 6, except that the plane of Arrow B is rotated about 90° from the plane of Arrow A. As discussed above, in this embodiment of the invention the knobs may be pivoted to three distinct positions in each direction—a neutral position, a forward position and a backward position. This configuration is of particular advantage in that the user can sense the state of the device 10 through touch, it is not necessary to visually inspect the device. It is to be understood that the pivotal connector 20 may be configured to provide a greater or lesser number of distinct positions for each knob. Moving the knobs until they are seated in distinctly defined positions facilitates the detection of the knob position as the knobs 16 are moved by the user as well as the ability of the user to interpret the tactile signal conveyed when the knobs are moved by the control system 14. However, a device in which the knobs may be moved to an unlimited number of positions is within the scope of the invention.

Figure 7A:
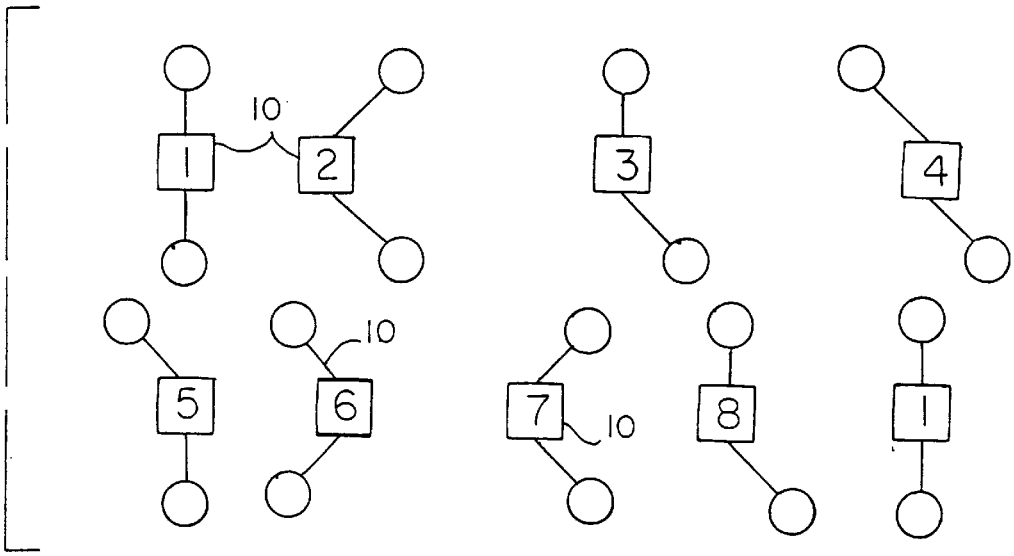
FIGS. 7A and 7B are diagrammatic views of the tactile device of FIG. 1, showing the device as it is moved through a tactile signal pattern.
Figure 7B:
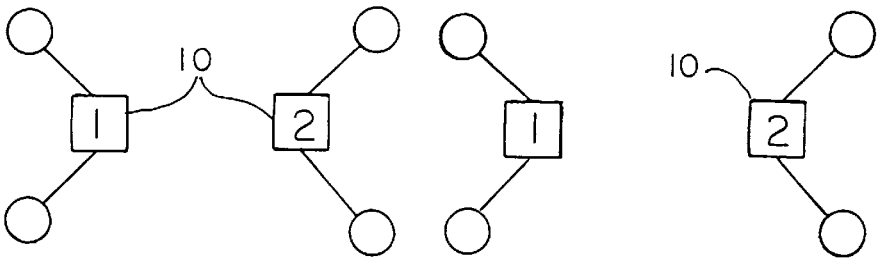

In FIG. 6, the knobs 16 of the device $\mathbf{10}_N$ are positioned in the neutral position, with the knobs being substantially aligned along the longitudinal axis of the device. The device may be manipulated into eight other positions by selectively moving the knobs to the forward, backward or neutral position. Device $\mathbf{10}_F$ has both knobs 16 in the forward position while device $\mathbf{10}_B$ has both knobs in the backward position. Providing the device 10 with two knobs provides a variety of different positions while maintaining simplicity. However, as is discussed above, in other modifications of the invention the device may have one knob or more than two knobs. In the illustrated embodiment, the forward and backward positions are each oriented at an angle of about 15° to 20° relative to the neutral position. A plurality of the different signal positions shown in FIG. 6 may be combined to form a tactile signal. A plurality of tactile signals, originating alternately with the user and the control system 14, may be combined to form a tactile signal pattern. This signal pattern may be a (game, a repetitive dance, a form of communication, and the like. FIGS. 7A and 7B illustrate examples of tactile signal patterns.

As is apparent from the foregoing, the hand-held device 10 of this invention may be used to communicate with others through tactile signals, without words, sounds or noticeable hand movements. The device also may be used to entertain and amuse the user without impairing the user's ability to concentrate on other activities or disrupting others in the vicinity of the user.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A first and a second hand-operated tactile devices, said devices being remote from each other, each said device comprising:

a tactile body positionable in one hand of a user, said tactile body including a first articulated member movable relative to the remainder of said body in a manual operation phase with the user manipulating said first articulated member relative to the remainder of said body and a second articulated member movable relative to the remainder of said body in an automatic operation phase with said second articulated member being movable relative to the remainder of said body and said hand of the user; and a control system carried by said body, said control system receiving a first signal from said first articulated member when said first articulated member is manually manipulated by the user and said control system generating a second signal controlling movement of said second articulated member to automatically move said second articulated member relative to the remainder of said body and said hand of the user, said first articulated member being movable in a first plane in said manual operation phase and said second articulated member being movable in a second plane intersecting said first plane in said automatic operation phase, characterized in that said control system of said first device directly transmits a first output to said control system of said second device to generate said second signal of said second device and further that said control system of said second device directly transmits a second output to said control system of said first device, each said control system including a storage device having at least one tactile signal pattern stored therein, said control system generating said second signal in response to the tactile signal pattern stored in said storage device, whereby movement of said first articulated member of said first device in said first plane causes movement of said second articulated member of said second device in said second plane and movement of said first articulated member of said second device in said first plane causes movement of said second articulated member of said first device in said second plane, the first plane of movement of each said first articulated member being orthogonal to the second plane of movement of said second articulated member.

2. The device of claim 1 in which each said body includes a stationary support member, each said articulated member being pivotally coupled to said stationary support member.

3. The device of claim 1 in which each said articulated member is movable between a plurality of discrete positions relative to the remainder of said body.

4. The device of claim 1 in which said articulated members are each movable relative to said body in a first reciprocal direction by the user and in second reciprocal direction different from the first reciprocal direction in response to the second signal generated by said control system.

5. The device of claim 4 in which the first reciprocal direction is orthogonal to the second reciprocal direction.

6. The device of claim 1 in which said articulated members are each coupled to a stationary support member in said body by a coupling member, said coupling member defining a plurality of distinct positions to which said articulated member may be moved relative to said stationary support member.

7. The device of claim 1 in which each said control system includes a receiver for receiving input from a source remote form said body, said control systems generating said second signals in response to input received by said receiver.

8. The device of claim 1 in which each said control system includes a transmitter for transmitting output to a source remote from said body, each said control system generating said output in response to said first signal.

9. This device of claim 1 in which each said control system includes a storage device having at least one tactile signal pattern stored therein, each said control system generating said second signal in response to the tactile signal pattern stored in said storage device.

* * * * *